US005630644A

United States Patent [19]

LaPointe et al.

[11] Patent Number: 5,630,644

[45] Date of Patent: May 20, 1997

[54] MODULAR SOFA ASSEMBLY AND MOUNTING APPARATUS FOR SECURING INDEPENDENT SECTIONS THEREOF

[75] Inventors: Larry P. LaPointe, Temperance; Jonathan R. Saul, LaSalle; Karl J. Komorowski, Petersburg; Richard E. Marshall, Monroe, all of Mich.

[73] Assignee: La-Z-Boy Chair Company, Monroe, Mich.

[21] Appl. No.: 429,535

[22] Filed: Apr. 26, 1995

Related U.S. Application Data

[63] Continuation-in-part of Ser. No. 209,159, Mar. 10, 1994, which is a continuation-in-part of Ser. No. 109,832, Aug. 20, 1993, Pat. No. 5,520,437.

[30] Foreign Application Priority Data

Aug. 22, 1994 [CA] Canada ..... 2130610

[51] Int. Cl.[6] ..... A47C 15/00

[52] U.S. Cl. ..... 297/232; 297/248; 297/113; 297/411.32

[58] Field of Search ..... 297/232, 248, 297/249, 68, 113, 115, 117, 135, 411.21, 411.32, 440.14, 440.1

[56] References Cited

U.S. PATENT DOCUMENTS

| | | | |
|---|---|---|---|
| 53,415 | 3/1866 | Cole . | |
| D. 83,452 | 2/1931 | Klemm et al. . | |
| D. 155,624 | 10/1949 | Pahlmann . | |
| D. 180,982 | 9/1957 | Woodward . | |
| D. 190,904 | 7/1961 | Kasparian . | |
| 797,826 | 8/1905 | Sherman, Jr. . | |
| 1,198,726 | 9/1916 | Huntley . | |
| 1,335,842 | 4/1920 | Lambert . | |
| 2,153,679 | 4/1939 | Rich . | |
| 2,716,775 | 9/1955 | Kenimer . | |
| 3,093,410 | 6/1963 | Wilson . | |
| 3,127,216 | 3/1964 | Clouse . | |
| 3,162,484 | 12/1964 | Kleffman . | |
| 3,227,487 | 1/1966 | Blanchard | 297/248 |
| 3,614,157 | 10/1971 | Hendrickson et al. . | |
| 3,620,567 | 11/1971 | Hendrickson et al. . | |
| 3,640,569 | 2/1972 | Young . | |
| 3,666,319 | 5/1972 | Moloney, Jr. . | |
| 3,731,956 | 5/1973 | Hanley . | |
| 3,841,701 | 10/1974 | Sullivan . | |
| 3,944,281 | 3/1976 | Piretti . | |
| 3,951,448 | 4/1976 | Hawie . | |
| 4,043,591 | 8/1977 | Lehmann . | |

(List continued on next page.)

FOREIGN PATENT DOCUMENTS

| | | | |
|---|---|---|---|
| 221202 | 10/1957 | Australia . | |
| 2817792 | 10/1979 | Germany . | |
| 284491 | 2/1928 | United Kingdom . | |
| 667245 | 12/1950 | United Kingdom . | |
| 724365 | 7/1953 | United Kingdom . | |
| 827904 | 7/1958 | United Kingdom . | |
| 831582 | 8/1958 | United Kingdom . | |
| 2127367 | 4/1984 | United Kingdom | 297/232 |

*Primary Examiner*—Laurie K. Cranmer
*Attorney, Agent, or Firm*—Harness, Dickey & Pierce, P.L.C.

[57] ABSTRACT

A sofa assembly including a low-profile center console section having a pair of rocking reclining chair sections releasably secured on either side thereof. As presently preferred, center console section provides an inboard armrest which may be positionable between an upright, raised position and a horizontal, use position, or alternatively, fixed in a horizontal, use position. The present invention further includes a mounting apparatus for securing independent sections of a modular sofa assembly together. An attachment plate and a keyhole fastener bracket are secured to the base assembly of each chair section. Complementary fastener bolts are secured to the center console section. When the chair section and center console section are aligned in side-by-side proximity, the fastener bolt extends through the keyhole and engages the fastener bracket. In this manner, a wide variety of individual furniture sections can be secured together to form a modular sofa assembly which is easily and readily assembled and disassembled.

21 Claims, 3 Drawing Sheets

U.S. PATENT DOCUMENTS

| | | | |
|---|---|---|---|
| 4,077,666 | 3/1978 | Heumann . | |
| 4,102,587 | 7/1978 | Herb et al. . | |
| 4,114,947 | 9/1978 | Nelson . | |
| 4,258,464 | 3/1981 | Ullman, Jr. . | |
| 4,311,337 | 1/1982 | Brunn . | |
| 4,395,071 | 7/1983 | Laird . | |
| 4,434,900 | 3/1984 | Cook . | |
| 4,435,011 | 3/1984 | Hakamata | 297/13 |
| 4,476,984 | 10/1984 | Garrett . | |
| 4,558,901 | 12/1985 | Yokoyama . | |
| 4,579,384 | 4/1986 | Sharod . | |
| 4,595,164 | 6/1986 | Froutzis et al. . | |
| 4,668,011 | 5/1987 | Fister, Jr. . | |
| 4,740,031 | 4/1988 | Rogers, Jr. . | |
| 4,848,839 | 7/1989 | Galardo . | |
| 4,848,843 | 7/1989 | Gibbs . | |
| 5,106,153 | 4/1992 | Durling | 297/232 |
| 5,116,099 | 5/1992 | Kwasnik et al. | 297/411.32 X |
| 5,234,253 | 8/1993 | LaPointe et al. . | |
| 5,292,171 | 3/1994 | Harrell | 297/113 |
| 5,314,234 | 5/1994 | England | 297/248 |
| 5,326,153 | 7/1994 | Muffi . | |
| 5,352,017 | 10/1994 | Berning | 297/248 |
| 5,395,156 | 3/1995 | Friedman | 297/232 |

FIG 1A
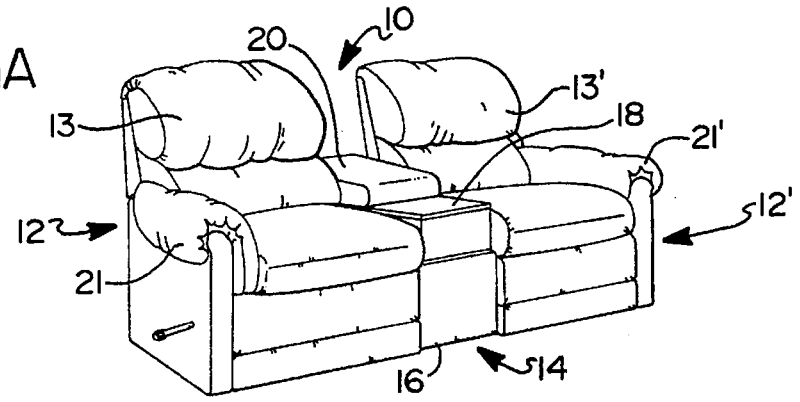
FIG 1B
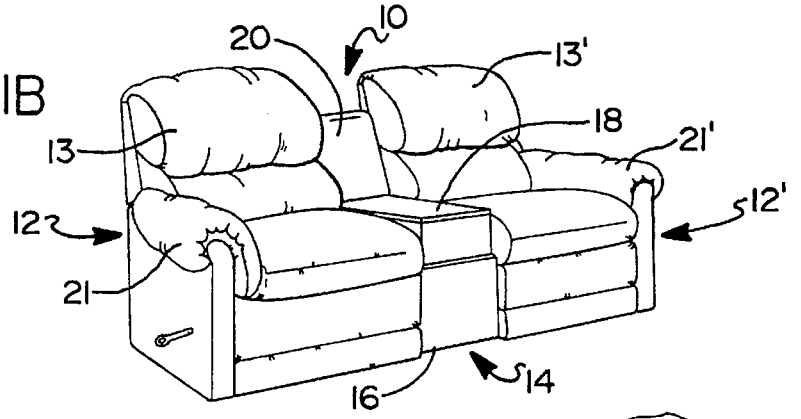
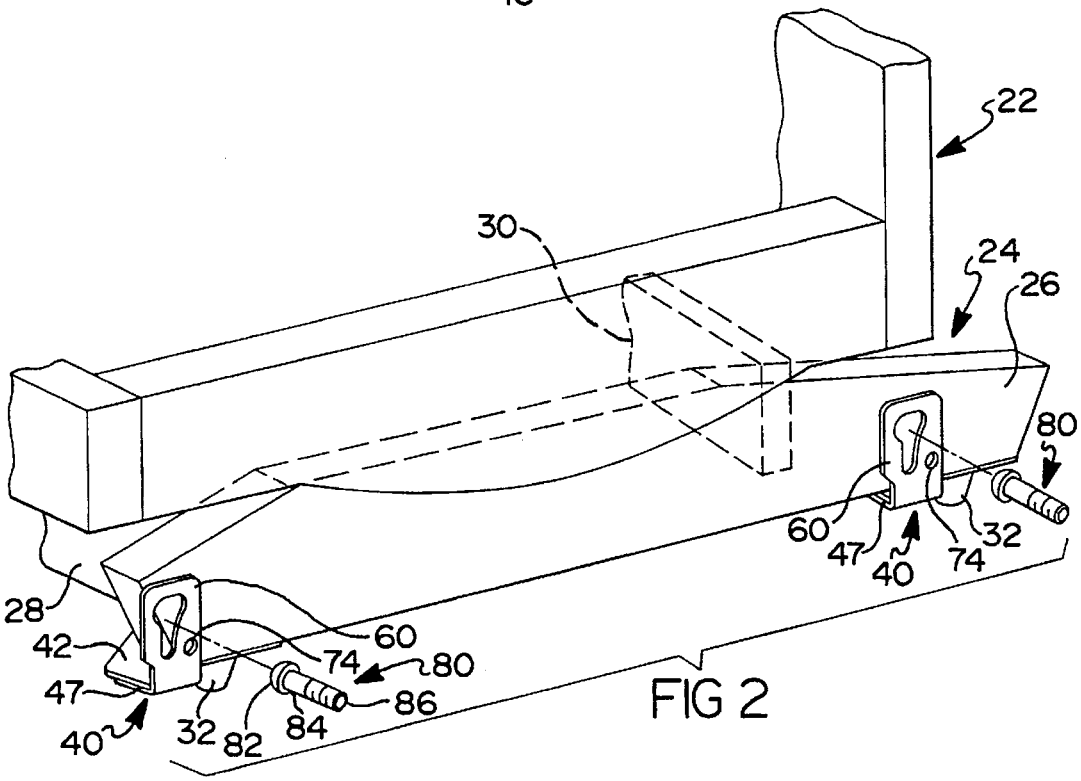
FIG 2

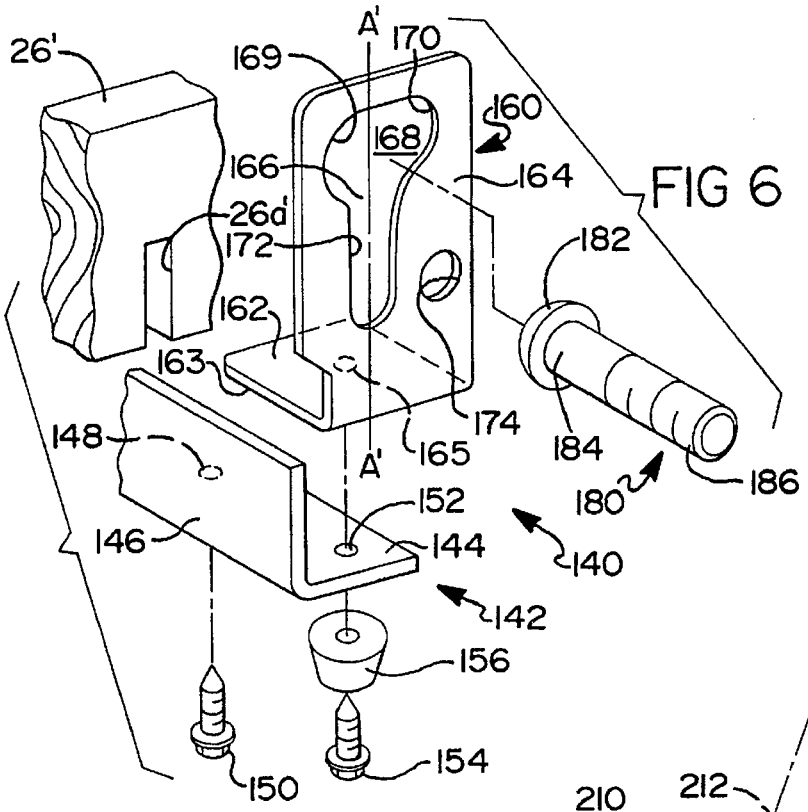
FIG 6
FIG 7
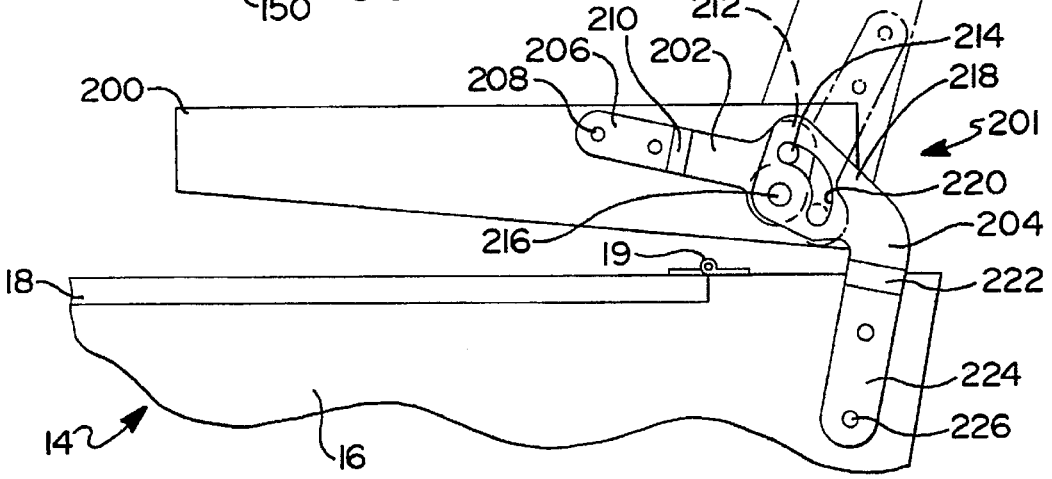
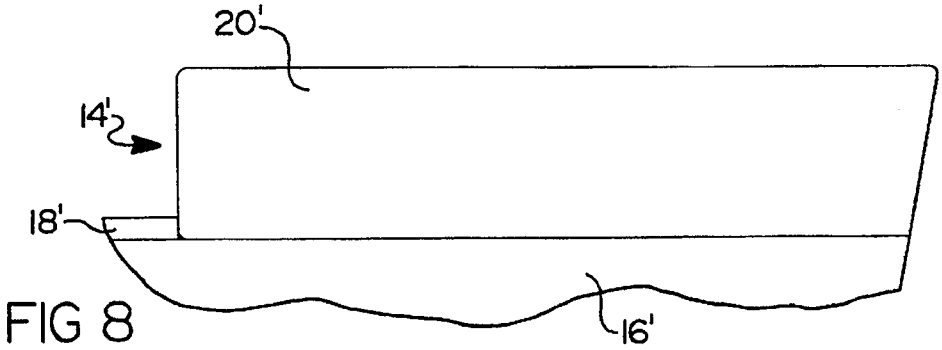
FIG 8

MODULAR SOFA ASSEMBLY AND MOUNTING APPARATUS FOR SECURING INDEPENDENT SECTIONS THEREOF

This application is a continuation-in-part of U.S. patent application Ser. No. 08/209,159 filed Mar. 10, 1994, which is a continuation-in-part of U.S. patent application Ser. No. 08/109.832, filed Aug. 20, 1993, now U.S. Pat. No. 5,520, 437.

BACKGROUND OF THE INVENTION

1. Technical Field

The present invention relates to a modular sofa assembly and, more particularly, to a sofa assembly having a pair of rocking-reclining chair sections removably secured to a low-profile center console section by a mounting apparatus in a side-by-side configuration.

2. Discussion

Present day sofas often incorporate one or more seating sections which function as recliners to provide a significant degree of added comfort when compared with conventional sofas which incorporate a single fixed seating arrangement. Such sofa assemblies incorporating one or more reclining seating sections enable the owner to "customize" a sofa assembly to fit his/her specific needs and lifestyle.

In this regard, U.S. Pat. No. 5,326,153 to Muffi discloses a sectional sofa arrangement that includes a glider/rocker recliner. However, certain comfort features of the rocker recliner are given up when utilized in this configuration. For example, the inboard arm rest of the rocker recliner is removed to enable the end unit chair to be assembled in the sofa assembly. Additionally, it would be advantageous to provide table top and storage areas proximate to the seating units.

With sofa assemblies as described above, it has heretofore been necessary to secure the various independent sections together via use of a permanent frame, usually constructed integrally with the various seating sections at the factory. Accordingly, the sofa assembly must be shipped as a single, relatively large structure.

While the permanent frame has proved to provide adequate structural strength to the sofa assembly, it would be desirable to provide means for securing the various sections of a modular sofa assembly together after the assembly has reached its destination. This would significantly ease the shipping and handling of such sofa assemblies as the various components thereof could be shipped and handled independently. At the destination, the ability to individually position the components of the assembly would contribute to its transportation, for example, within hallways and through doorways of rooms in a home, apartment or office. This ability would also allow a sofa assembly to be placed in rooms which previously were inaccessible for the unitary, large and cumbersome assemblies. The overall weight of these unitary assemblies would make a typical sofa difficult to handle and transport, whereas the individual components are easily handled and transported when detached from the sofa assembly.

It would further be desirable if such a frame-like mounting apparatus as described above incorporated some means of enabling the modular sections of the sofa assembly to be laterally adjusted to compensate for variations in thicknesses of fabric and padding of individual components, as well as design differences between dissimilar components. The need for allowing some adjustability in a frame-like mounting apparatus as described above is particularly acute when one or more rocker recliner chair sections are included in the modular sofa assembly. The rocker recliner sections must be able to rock and recline freely with a minimum amount of friction from adjacent modular components, and yet the clearance between the rocker recliner sections in other components must not be so great as to create unsightly gaps between adjacent sections of the sofa assembly.

An advantage of such a frame-like mounting apparatus would be the flexibility in changing the configuration of the sofa assembly as the needs of the owner change. For example, if the sofa assembly was originally purchased with three sitting sections, the center seat section could, at a later time, be replaced with a center console section, or vice versa. Accordingly, there would be no need for the owner to order an entire new sofa assembly if the owner desired to utilize the sofa in a different configuration than originally purchased.

Still additional advantages would be derived from a mounting apparatus which is secured to the individual frame components associated with each individual section. The mounting apparatus of each individual component could be used to easily and rigidly interconnect the frame members of each seating section. The mounting apparatus should be small and lightweight such that the average homeowner would easily be able to assemble the modular unit.

It is therefore a principal object of the present invention to provide a sofa assembly which includes a pair of rocking reclining chairs positioned on either side of a center console section.

A further object of the present invention provides an arm rest which may be fixedly or movably positioned in a use position on the inboard side of the chair.

It is another object of the present invention to provide a low-profile center console section which facilitates rocking reclining motion of a seated occupant.

It is yet another object of the present invention to provide a mounting apparatus for a modular sofa assembly which allows various sections of a modular sofa assembly to be removeably secured together at the factory or at the destination where the sofa assembly is to be installed.

It is still a further object of the present invention to provide a mounting apparatus which may be secured to various sections of a modular sofa assembly, quickly, easily and without requiring special tools.

It is yet another object of the present invention to provide a mounting apparatus which enables independent seating sections to be easily and conveniently shipped and handled and subsequently secured together to form a modular assembly.

It is still another object of the present invention to provide a mounting apparatus which is very inexpensive to produce and which does not add appreciably to the overall complexity of the modular sofa or its assembly.

SUMMARY OF THE INVENTION

The above and other objects of the present invention are accomplished by removably securing a pair of rocking recliner chairs in a side-by-side configuration to a low-profile center console table with a bracket apparatus in accordance with the preferred embodiments of the present invention. In a preferred embodiment, the rocking recliner chair sections include a base assembly adapted to enable them to be arranged in a modular sofa assembly. In a preferred embodiment, the center console section provide includes a base assembly adapted to be arranged in side-by-side relationship with the chair sections and an inboard arm rest which is positionable between a horizontal, use position and an upright, storage position. The center console section may also provide a table top and/or additional storage proximate to the chair section. In a preferred embodiment, the mounting apparatus provides a first and second bracket assembly secured to the chair and console base assemblies, respectively, at the factory. First and second bracket assemblies are complementary in design such that when placed in adjacently abutting engagement, the first and second bracket assemblies releasably secure the adjacent independent sections together.

In an exemplary embodiment, first bracket assembly includes an attachment plate secured to the frame portion of a first independent section and a keyhole fastener plate secured to the attachment plate and positioned along a sidewall portion of the independent section. The second bracket assembly is secured to a sidewall of a second modular section and includes an elongated shaft and an enlarged head portion which protrudes generally perpendicularly outwardly therefrom. The first and second furniture sections are secured together by positioning the second furniture section such that the enlarged head portion of the fastener protrudes through the keyhole like opening in the keyhole fastener plate. One of the two sections is then moved relative to the other so as to urge the enlarged head portion of the fastener into a slot of the keyhole like opening, thus releasably securing the two independent sections closely adjacent one another in a side-by-side fashion.

The preferred embodiments of the present invention provide a very cost effective yet simple to manufacture means by which one or more modular sections, whether they be fixed, reclining, rocking, or rocking reclining chair sections or console sections, can be quickly and easily secured together to form a modular sofa assembly. The preferred embodiments further provide for a degree of adjustability between the spacing of the furniture sections as well as allowing the furniture sections to be quickly and easily uncoupled from one another when the modular sofa assembly is to be moved. In this manner, the individual sections of a modular sofa assembly may be quickly and easily secured together with relatively little expertise.

It will be appreciated, then, that the preferred embodiments disclosed herein provide a significant advantage in that shipping and handling of the modular sofa assembly is much more easily accomplished than if the assembly was secured together at a factory, dealership, etc. The preferred embodiments disclosed further do not require any special tools to enable the bracket assemblies or fastener assemblies to be secured to the furniture sections of the modular sofa assembly.

BRIEF DESCRIPTION OF THE DRAWINGS

Various advantages of the present invention will become apparent to one skilled in the art by reading the following specification and subjoined claims and by referencing the following drawings in which:

FIGS. 1A and 1B are perspective views of an exemplary modular sofa assembly which includes a pair of rocking recliner chairs separated by a console table having a positionable armrest for providing a low-profile center console section;

FIG. 2 is a perspective view, broken away, of a rocking recliner chair section illustrating a front and rear bracket assembly secured to the base of the chair section and a pair of complementary fastener studs which would be secured to an adjacent independent section;

FIG. 6 illustrates an alternate embodiment of the first bracket assembly of the present invention which incorporates frame rails in place of the attachment plates illustrated in FIGS. 2–5;

FIG. 7 illustrates the armrest portion of the center console section of the present invention, including a linkage mechanism for positioning the arm rest between a upright, raised position and a horizontal, use position; and FIG. 8 represents an alternate embodiment of the center console section of the present invention in which the armrest portion is fixedly secured in the horizontal use position.

DETAILED DESCRIPTION OF THE PREFERRED EMBODIMENTS

Figure 3:
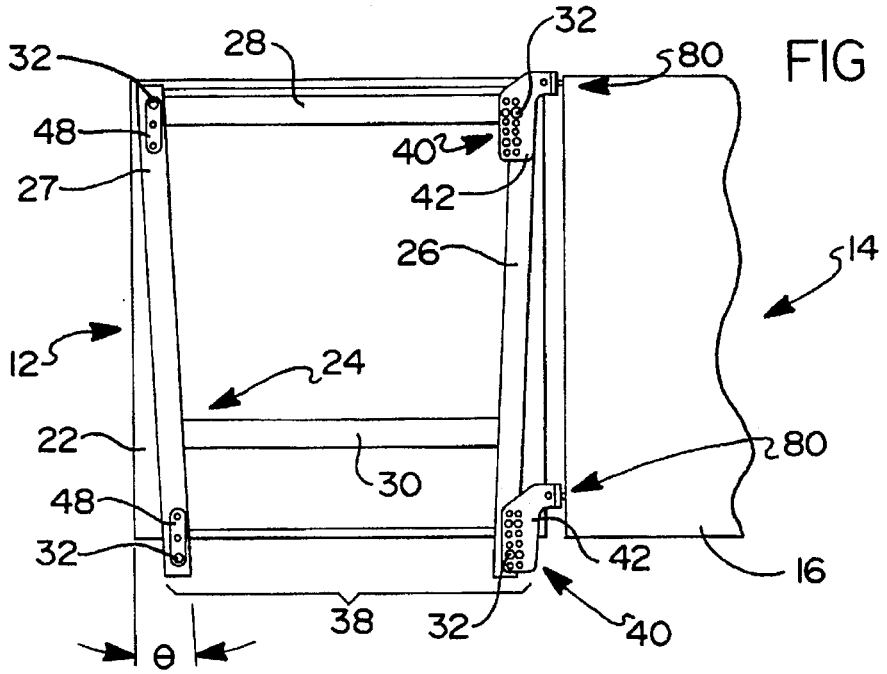
FIG. 3 is a plan view of the bottom of the chair section shown in FIG. 2 releasably secured to a center console section.

In accordance with the teachings of the present invention a modular sofa assembly which includes a center console section removably secured between a pair of rocking reclining chair sections, and a mounting apparatus for removably securing the above-described independent sections together is disclosed. In relation to the presently preferred configuration, it should be understood that the mounting apparatus of the present invention, while described with respect to a pair of rocking reclining chairs and a console section, is readily adaptable to a variety of furniture sections.

Referring to FIG. 1A, modular sofa assembly 10 of the present invention is illustrated having a left and right rocking reclining chairs 12, 12', which have back portions 13, 13' and outboard armrests 21, 21', positioned and removably secured on either side of center console table 14. Except as noted herein, the present invention does not dictate or require a specific construction for rocking reclining chair 12. A presently preferred chair is disclosed in the commonly assigned U.S. Pat. No. 5,382,073 and U.S. application Ser. No. 08/100,916, the disclosures of which are hereby expressly incorporated herein by reference. Center console table 14 includes upholstered table base 16 situated at the lower portion of center console table 14, wooden table top 18 disposed on top of table base 16, and upholstered console armrest assembly 20 operably coupled along a rear upper edge of table top 18. As presently preferred, console armrest assembly 20 is movable between a horizontal, use position as illustrated in FIG. 1A and an upright raised position as illustrated in FIG. 1B. When positioned in the upright, raised position console armrest assembly 20 is substantially in-line with seat back portions 13, 13' of chair sections 12, 12', thus defining a console back portion which provides a modular sofa assembly having a contiguous back appearance. When in the horizontal, use position console armrest assembly 20 defines a low-profile console back portion between chair sections 12, 12' and functions as an inboard armrest for an occupant seated therein. Additionally, in this position, console armrest assembly 20 is placed in a position so as to not obstruct a seated occupant's rocking or reclining movement while in chair 12. For example, in the horizontal, use position, console armrest assembly 20 is positioned out of the way of a seated occupant's arm located on the inboard side of rocking reclining chair 12. Thus, when the seated occupant is rocking or reclining, motion of his or her arm will not be impeded by that portion of the center console section. Furthermore, console armrest assembly 20 functions as an elevated, inboard, padded armrest which would not otherwise be provided on a fixed back center console.

Referring now to FIGS. 2–5, mounting apparatus 38 in accordance with a preferred embodiment of the present invention is illustrated which includes inboard attachment bracket assembly 40 and outboard base plate 48. Mounting apparatus 38 is especially well suited for use with rocking reclining type chair sections. Referring to FIG. 2 in which the upholstery, padding and rocking reclining mechanisms have been removed, chair section 12 includes chair frame assembly 22 supported on base assembly 24 to provide relative rocking movement between chair frame 22 and base assembly 24. As shown in FIGS. 2 and 3, base assembly 24 includes a pair of laterally spaced side frame members 26 and 27, front frame member 28 and rear frame member 30. Inboard and outboard side frame members 26 and 27 are arranged in a tapered configuration as they extend from the front to the rear portion of rocking reclining chair 12. In a typical chair configuration side frame members 26 and 27 are tapered from front to back as indicated in FIG. 3 by the angle Θ which is typically approximately 3°. Feet portions 32 are provided on base assembly 24 to support and level chair section 12 on the floor.

Inboard bracket assembly 40 includes bracket attachment plate 42 secured to the bottom portion of inboard side frame member 26, fastener bracket 60 having keyhole 66 therein disposed at an end of bracket attachment plate 42, and fastener stud or bolt 80 secured to an adjacent section of the modular sofa assembly 10. Fastener bolt 80 includes enlarged head portion 82 and shank 84 having threaded portion 86 for securing fastener bolt 80 to a side wall portion of an adjacent section such as base assembly 16 of center console section 14, as shown in FIG. 3. As can be appreciated from the figures, inboard bracket assembly 40 is located on inboard side frame member 26 so as to afford sufficient clearance at the front and rear portions of base assembly 24 for allowing chair frame assembly 22 to rock relative to base assembly 24.

Figure 4A:
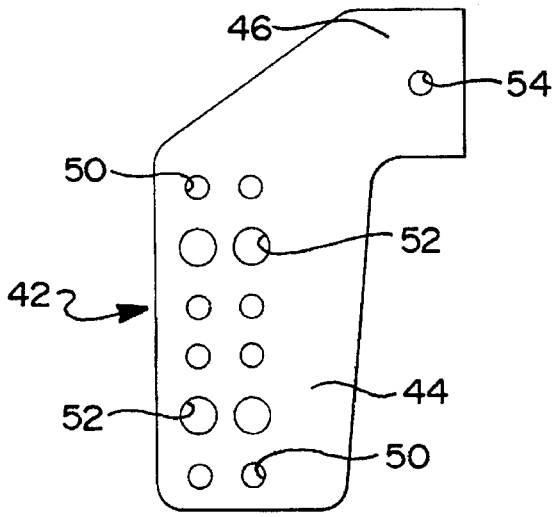
FIGS. 4A and 4B illustrate attachment and base plates secured to the base portion of an independent section as shown in FIG. 3.
Figure 4B:
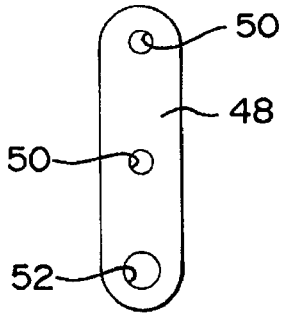
Figure 5:
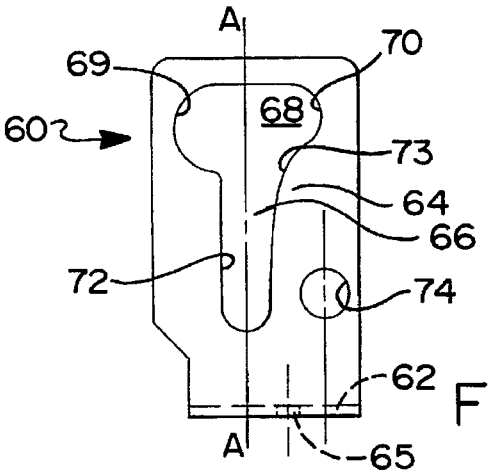
FIG. 5 illustrates the fastener plate having an asymmetric keyhole.

Turning to FIGS. 3–5, a pair of bracket attachment plates 42 are disposed on inboard side frame member 26 generally parallel thereto. The presently preferred embodiment allows the use of universal mounting apparatus 38 irrespective of its location, i.e., on the front, rear, left or right corners depending on the location of the individual section in the sofa assembly. Accordingly, the following description relates to one mounting apparatus 38. One skilled in the art would readily appreciate that mounting apparatus 38 could be utilized at any location simply by translating or rotating mounting apparatus 38 accordingly.

Bracket attachment plate 42 includes elongated portion 44 which is positioned generally beneath inboard frame member 26 and lateral portion 46 extending generally perpendicular to elongated portion 42. Elongated portion 44 includes a first set of apertures 50, 52 extending generally parallel with the major axis thereof. In the presently preferred embodiment, two sizes of apertures are utilized—chair attachment apertures 50 for receiving a threaded fastener (not shown) to secure bracket attachment plate to side frame member 26, and foot attachment aperture 52 for securing foot portion 32 to bracket attachment plate 42.

Furthermore, as presently preferred, bracket attachment plate 42 includes an second set of apertures 50, 52 extending generally parallel to elongated portion 44 near the edge opposite lateral portion 46 but inboard of the first set of apertures 50, 52. As best illustrated in FIG. 3, first and second set of apertures enable bracket attachment plate 42 to be secured to side frame member 26 in a fashion that is generally parallel to the side wall of an adjacent sectional unit. For example, when bracket attachment plate 42 is positioned at the front corner of chair 12, the second set of apertures are used to secure bracket attachment plate 42 to side frame member 26 and when bracket attachment plate 42 is positioned at the rear corner of chair 12, the first set of apertures are used to secure bracket attachment plate 42 to side frame member 26. The use of different apertures to attach bracket attachment plate 42 to side frame member 26 at different locations takes into account the front to rear taper of side frame member 26 previously described.

Outboard base plate 48, as illustrated in FIGS. 3 and 4B, is located on outboard side frame member 27 on an end chair section, in a manner similar to inboard attachment plate 46. A set of apertures extending generally parallel to outboard base plate 48 are formed therein and include chair attachment apertures 50 and foot attachment apertures 52. Foot portion 32 is disposed in foot attachment aperture 52 of outboard base plate 48 to keep the base assembly 24 level.

Turning now to FIG. 5, keyhole fastener bracket 60 includes first wall portion 62 and second wall portion 64 extending generally perpendicular to first wall portion 62. Keyhole fastener bracket 60 is disposed below bracket attachment plate 42 on lateral portion 46 such that first wall portion 62 extends generally planar with bracket attachment plate 42 and second wall portion 64 extends generally vertically therefrom. First wall portion 62 includes aperture 65 therethrough. Likewise, lateral portion 46 of bracket attachment plate 42 includes threaded bracket attachment aperture 54 to receive a threaded fastener (not shown) for securing fastener bracket 60 to bracket attachment plate 42. Second wall portion 64 engages end portion 47 of lateral portion 46 for preventing rotation of keyhole fastener bracket 60 about the threaded fastener. Once secured to chair section 12, fastener bracket 60 is positioned such that second wall portion 64 is spaced from side frame rail 26 by a distance sufficient to allow the head 82 portion of fastener bolt 80 to extend through keyhole 66.

Keyhole 66 formed in second wall portion 64 is generally asymmetrically shaped with respect to axis A—A illustrated in FIG. 5 and includes enlarged opening 68 and slotted portion 72. Enlarged opening 68, a tapered oval or egg-shaped opening, is substantially larger than headed portion 82 of fastener bolt 80 and includes forward portion 69 and rearward portion 70. The shape of enlarged opening 68 is dictated by the clearance needed to quickly and easily extend enlarged head portion 82 through fastener bracket 60 during assembly of adjacent sections. Slotted portion 72 extends radially from enlarged opening 68 in a generally vertically downward direction and is smaller in dimension than enlarged head portion 82 such that shank portion 84 can pass therethrough while enlarged head portion 82 engages fastener bracket 60 when fastener bolt 80 is appropriately positioned. Slotted portion 72 may be substantially constant in width or slightly inwardly tapered from the enlarged portion towards first wall portion 62 to facilitate engagement of shank portion 84 of fastener bolt 80. Furthermore, the transition from enlarged portion 68 to slotted portion 72 may be smoothed, as shown at reference number 73, to facilitate positioning of fastener bolt 80 therebetween.

Adjacent furniture sections are secured together by positioning center console section 14 such that head portion 82 of fastener bolt 80 extends through the enlarged opening 68 in second wall portion 64. Center console section 14 is then moved vertically downward with respect to chair section 12 such that a portion of shaft 84 is urged into slotted portion 72 and becomes wedgingly engaged therein. Enlarged head portion 82, being of greater diameter than slot 72, prevents fastener bolt 80 from being pulled through fastener bracket 60.

In some instances, it is advantageous and desirable to releasably secure together a first and second sectional unit which are both equipped with inboard bracket assembly 40. To accommodate this configuration, second wall portion 64 of fastener bracket 60 is provided with threaded aperture 74 such that keyhole 66 and aperture 74 are equally spaced from the center of aperture 65. In addition, threaded aperture 74 is adapted to receive fastener bolt 80 heretofore described. Accordingly, when fastener bolt 80 is fitted into threaded aperture 74 of one of the fastener brackets that are placed in face-to-face relationship, fastener bolt 80 aligns with and extends through keyhole 66 of the other fastener bracket to maintain the bracket assemblies, and thus the sectional units, in side-by-side relationship. In this way, the present invention may be utilized with adjacent furniture sections having identical bracket assemblies for releasably securing the sections together in side-by-side relationship.

Referring now to FIG. 6, bracket assembly 140 in accordance with alternate preferred embodiment of the present invention is shown. Bracket assembly 140 generally comprises L-shaped frame rail 142 secured to side frame member 26', a plurality of keyhole fastener brackets 160 disposed to the inboard end of frame rail 142 and fastener bolt 180 associated with each keyhole fastener bracket 160 secured to an adjacent furniture section. Frame rail 142 extends outwardly from inboard side frame member 26' but not from the outboard frame member (not shown). Thus, the exposed side of the end seating or chair section can be upholstered to provide a finished look.

Still referring to FIG. 6, frame rail 142 is disposed generally parallel to and between front and rear frame members (not shown). Slot **26*a*' is formed in side frame member 26' to receive frame rail 142 which includes horizontal wall portion 144 and vertical wall portion 146. A similar slot would be formed in the outboard side frame member. Horizontal wall portion 144 has frame attachment aperture 148 disposed therein which aligns with side frame member 26' such that threaded fastener 150 secures frame rail 142 to side frame member 26'. Similarly, a frame attachment aperture is formed in frame rail 142 which aligns with the outboard side frame member (not shown) such that a threaded fastener secures frame rail 142 to the outboard side frame member. Frame rail 142 further includes bracket attachment aperture 152 to allow threaded fastener 154 to pass therethrough for securing keyhole fastener bracket 160 thereto. Additional feet portions 156 may be interdisposed between the threaded fasteners and frame rail 142 to further support and provide leveling adjustment for chair section 12** on the floor.

Keyhole fastener bracket 160 is substantially similar to keyhole fastener bracket 60 previously described herein and includes first wall portion 162 and second wall portion 164. However, keyhole fastener bracket 160 is disposed on top of horizontal wall portion 144 of frame rail 142. In this arrangement, vertical wall portion 146 engages edge 163 of first wall portion 162 for preventing rotation of keyhole fastener bracket 160 about threaded fastener 154. Second wall portion 164 includes keyhole 166 formed therein to allow fastener stud or bolt 180 to engage second wall portion 164. First wall portion 162 includes aperture 165 therethrough to received the threaded fastener 154 which engages and secures keyhole fastener bracket 160 to frame rail 142. Aperture 152 may be an elongated slot to provide inboard/outboard adjustment of keyhole fastener bracket 160 relative to the base assembly (not shown). As with the first preferred embodiment, keyhole 166 includes enlarged opening 168 and slotted portion 172. With the exception of the heretofore noted differences, bracket assembly 140 operates in substantially the same manner as bracket assembly 40 herein described above.

While the above description is directed to a modular sofa assembly including a center console section having a pair of rocking reclining chair sections located on either side thereof, one skilled in the art would readily recognize that the mounting apparatus is not so limited and could be utilized to releasably secure a variety of sectional units. By way of example, any number of the following sectional units could be employed to form the modular sofa assembly of the present invention—a stationary seating section, a reclining seating section, a rocking seating section, a rocking reclining seating section, a wall proximity reclining section, a center console section or an end console section. Thus, the mounting apparatus of the present invention affords a simple and economic way to releasably secure a wide variety of sectional units together to form a modular sofa assembly.

Referring now to FIG. 7 in which the upholstery and padding for console armrest assembly 20 are not shown, center console table 14 includes base 16 having a finished wood top 18 disposed thereon and console armrest assembly 20 including armrest frame 200. Table top 18 is secured to base 16 via hinge 19 to permit access to the interior compartment of base 16 for storage. Armrest linkage 201 pivotally interconnects console armrest assembly 20 and table base 16 such that console armrest assembly 20 is positionable between a horizontal, use position and an upright, raised position. Armrest linkage 201 includes armrest bracket 202 secured to armrest frame 200 and table base bracket 204 secured to table base 16. Armrest bracket 202 is generally T-shaped and includes attachment end 206 having attachment apertures 208 therethrough for receiving threaded fasteners (not shown) to secure armrest bracket 202 onto armrest frame 200. Armrest bracket 202 further includes pivot end 212 opposite attachment end 206 having guide pin 214 extending generally perpendicular to the plane of armrest attachment bracket 202. Pivot 216 is also disposed on pivot end 212 to couple armrest bracket 202 with table base bracket 204. Armrest bracket 202 further includes bend 210 interdisposed between attachment end 206 and pivot end 212 for placing pivot end 212 in a slightly spaced apart relationship from armrest frame 200 for enabling pivotal movement of console armrest assembly 20 with respect to table base 16.

Table base bracket 204 includes pivot end 218 which is located proximately with pivot end 212 of armrest bracket 202. Arcuate guide slot 220 is formed in pivot end 218 for receiving guide pin 214 to guide console armrest assembly 20 during rotational movement from the horizontal, use position to the upright, raised position and for defining the limits of this pivotal motion. Attachment end 224 opposite pivot end 218 includes a pair of attachment apertures 226 therethrough for receiving threaded fasteners (not shown) to secure table base bracket 204 to table base 216. As with armrest bracket 202, bend 222 is formed in table base bracket 204 between pivot end 218 and attachment end 224 for providing clearance between console armrest assembly 20 and adjacent chair sections 12 and 12'.

Referring now to FIG. 8, an alternate preferred embodiment of the present invention is illustrated wherein pivotal console armrest assembly 20 is replaced by an upholstered armrest which is fixedly secured to table base 16 such that it remains in the horizontal, use position. Thus, a sofa assembly constructed in accordance with the alternate embodiment would have a similar low-profile appearance as modular sofa assembly 10 depicted in FIG. 1A. With continued reference to FIG. 1A, one skilled in the art would readily appreciate that center console section 14 could include various convenience features not illustrated therein. For example, table base 16 may be provided with a drawer, door or pockets to enable a seated occupant to store various items therein. Alternatively, a variety of convenience features may be incorporated into tabletop 18, such as cup holders, ashtrays, or the like.

From the above discussion it should be appreciated that the preferred embodiments of the present invention described herein provide a modular sofa assembly having a center console section and a pair of rocking reclining chairs located on either side thereof. Rocking reclining motion of the adjacent chair sections is accommodated with a low-profile center console table. In one preferred embodiment, a console back portion is positionable between an upright, raised position which gives the sofa assembly a substantially contiguous upholstered look and a horizontal, use position which provides an upholstered armrest for a seated occupant. The low-profile center console section further facilitates rocking reclining motion by positioning the console back portion so as to reduce interference with the seated occupant's arm during rocking and reclining motion. In an alternate embodiment of the present invention, the console armrest assembly is fixedly secured to the table base in a horizontal, use position.

The present invention described herein further provides a quick, easy and convenient means by which the pair of rocking, reclining chair sections can be releasably secured to the center console section. The preferred embodiments further do not require the use of special tools for extensive skills in order to implement. Accordingly, the individual furniture sections of the sofa assembly can be quickly and easily assembled and disassembled once the individual sections are delivered to a home, office, etc. The specific construction of the preferred embodiments enables each to be manufactured relatively simply from widely available materials, such as metal, by widely available manufacturing techniques, and provides the added benefit of not adding appreciably to the overall cost or weight of the modular sofa assembly.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. A modular sofa assembly including a plurality of furniture sections comprising:

at least one chair section having a chair frame and a chair back portion having a first height, said chair frame operably coupled to a chair base for providing relative movement therebetween;

a console section having a console base and a low-profile console back portion positionable between an upright, raised position substantially in-line with said chair back portion for providing a substantially contiguous sofa back and a horizontal, use position defining a second height which is less than said first height for providing clearance laterally adjacent said chair back portion; and mounting means for releasably securing said chair base to said console base in side-by-side relationship, said mounting means adapted to permit relative movement between said chair frame and said console section.

2. The modular sofa assembly of claim 1 further comprising:

said chair section having an outboard armrest; and said console back portion providing an inboard armrest for said chair section.

3. The modular sofa assembly of claim 1 wherein said mounting means further comprises:

a bracket assembly secured to said chair base and extending laterally outwardly therefrom, said bracket assembly having a keyhole formed therethrough; and a fastener bolt having a shank portion secured to said console base and extending laterally outwardly therefrom and a headed portion adapted to extend through said keyhole and engage said bracket assembly to releasably secure said chair base to said console base in side-by-side relationship.

4. The modular sofa assembly of claim 3 wherein said bracket assembly comprises:

an attachment plate secured to said chair base; and a fastener bracket secured to said attachment plate and having said keyhole formed therein.

5. The modular sofa assembly of claim 4 wherein said keyhole is asymmetrically shaped.

6. The modular sofa assembly of claim 5 wherein said asymmetrically-shaped keyhole comprises an asymmetrically-shaped enlarged opening having a forward portion and a rearward portion, said forward portion providing a larger opening than said rearward portion, and a slotted portion extending radially from said enlarged opening.

7. The modular sofa assembly of claim 4 wherein said attachment plate comprises a substantially flat plate having an elongated portion secured to a bottom surface on said chair base and a lateral portion extending laterally outwardly from said elongated portion and said chair base, said fastener bracket including a first wall portion secured to said lateral portion of said attachment plate and a second wall portion having said keyhole formed therethrough.

8. A modular sofa assembly including a plurality of furniture sections comprising:

a first chair section having a first chair frame including a first chair back portion and a first chair base operably coupled to said first chair frame for providing relative movement therebetween;

a second chair section having a second chair frame including a second chair back portion and a second chair base, said first and second chair back portions having a first height;

a console section including a console base and a console back portion positionable between an upright, raised position substantially in-line with said chair back portion for providing a substantially contiguous sofa back and a horizontal, use position for providing lateral clearance between said first and second chair back portion;

mounting means for releasably securing said first and second chair bases to said console base such that said console section is interdisposed between said first and second chair sections in side-by-side relationship, said mounting means being adapted to permit relative movement between said first chair frame and said console section.

9. The modular sofa assembly of claim 8 wherein said first and second chair sections are rocking reclining chair sections.

10. The modular sofa assembly of claim 8 further comprising:

said first and second chair sections having an outboard armrest; and said console back portion providing an inboard armrest for said first and second chair sections.

11. The modular sofa assembly of claim 10 wherein said console back portion further comprises:

an armrest frame;

an armrest link secured to said armrest frame at a first end and having a pivot and a guide pin disposed on a second end; and a console base link secured to said console base at a first end and pivotally coupled to said armrest link at a second end, said console base link having an arcuate slot formed in said second end for receiving said guide pin;

whereby said armrest frame is pivotally positionable between said upright, raised position and said horizontal, use position.

12. The modular sofa assembly of claim 8 wherein said mounting means further comprises:

a bracket assembly secured to each of said first and second chair bases and extending laterally outwardly therefrom, each of said bracket assemblies having a keyhole formed therethrough; and a plurality of fastener bolts, each of said fastener bolts having a shank portion secured to said console base and extending laterally outwardly therefrom, and a headed portion adapted to extend through said keyhole and engage said bracket assembly to releasably secure said first and second chair bases to said console base in side-by-side relationship.

13. The modular sofa assembly of claim 12 wherein each of said bracket assemblies comprise:

an attachment plate secured to said chair base; and a fastener bracket secured to said attachment plate and having said keyhole formed therein.

14. The modular sofa assembly of claim 13 wherein said keyhole is asymmetrically shaped.

15. In a modular sofa assembly of the type having an improved mounting apparatus for releaseably securing a first furniture section having a first base to a second furniture section having a second base in side-by-side relationship, wherein the improved mounting apparatus comprises:

a bracket assembly including an attachment plate secured to the first base and extending laterally outwardly therefrom and a fastener bracket having a first wall portion secured to said attachment plate and a second wall portion having a keyhole therethrough; and a fastener bolt having a shank portion secured to said second base and extending laterally outwardly therefrom and a headed portion adapted to extend through said keyhole and engage said fastener bracket for releasably securing said first base to said second base when the first and second furniture sections are positioned in said side-by-side relationship.

16. The modular sofa assembly of claim 15, wherein said attachment plate further comprises an elongated portion having a first set of apertures therethrough for receiving a fastener to secure said attachment plate to said first base and a lateral portion extending generally perpendicular to said elongated portion and outwardly from said first base, said first wall portion of said fastener bracket being secured to said lateral portion.

17. The modular sofa assembly of claim 16, wherein the first base is tapered inwardly from front to rear, the mounting apparatus further comprising:

a front bracket assembly secured to a front portion of the first base;

a rear bracket assembly secured to a rear portion of the first base;

each of said elongated portions of said front and rear bracket assemblies having a second set of apertures therethrough generally parallel to said first set of apertures for receiving a fastener to secure each of said attachment plate to said first base, said first and second sets of apertures being adapted to accommodate said taper of said first base such that said second wall portions of said front and rear bracket assemblies are substantially parallel;

a front fastener bolt secured to a front portion or the second base; and a rear fastener bolt secured to a rear portion of the second base.

18. The modular sofa assembly of claim 16 wherein said attachment plate is a substantially flat plate.

19. The modular sofa assembly of claim 15 wherein said keyhole is asymmetrically shaped.

20. The modular sofa assembly of claim 19 wherein said asymmetrically-shaped keyhole comprises an asymmetrically-shaped enlarged opening having a forward portion and a rearward portion, said forward portion providing a larger opening than said rearward portion, and a slotted portion extending radially from said enlarged opening.

21. The modular sofa assembly of claim 15 wherein said mounting apparatus further comprises:

a base plate secured to the first base; and a plurality of feet disposed on said base plate and said attachment plate for supporting and leveling said modular sofa assembly.

* * * * *